US006814648B2

(12) United States Patent
Chong

(10) Patent No.: US 6,814,648 B2
(45) Date of Patent: Nov. 9, 2004

(54) REUSABLE STRAPLESS AND BACKLESS BRA

(76) Inventor: Lawrence Wai Yiu Chong, 171 Eastgate Dr., Cheshire, CT (US) 06410

( * ) Notice: Subject to any disclaimer, the term of this patent is extended or adjusted under 35 U.S.C. 154(b) by 0 days.

(21) Appl. No.: 10/337,522

(22) Filed: Jan. 7, 2003

(65) Prior Publication Data

US 2003/0129923 A1 Jul. 10, 2003

Related U.S. Application Data

(60) Provisional application No. 60/346,706, filed on Jan. 7, 2002.

(51) Int. Cl.[7] ..... A41C 3/00
(52) U.S. Cl. ..... 450/81; 450/88
(58) Field of Search ..... 450/81, 1, 82, 450/83, 88, 53–56; 2/267

(56) References Cited

U.S. PATENT DOCUMENTS 4,553,550 A * 11/1985 Hattori ..... 450/81

6,231,424 B1 * 5/2001 Valentin ..... 450/81

* cited by examiner

*Primary Examiner*—Gloria M. Hale
(74) *Attorney, Agent, or Firm*—McCormick, Paulding & Huber LLP

(57) ABSTRACT

A reuseable fastener for attaching a garment or other item to a user is disclosed. The fastener including a pad having an adhesive on one side and a first fastener member attached to an opposing side thereof, the adhesive being adherable to a user's body for attaching the pad thereto. A garment having at least one second fastener member attached thereto, the second fastener member being releasably coupleable to the first fastener member such that the garment can be worn by a user by adhering the pad to the user's body via the adhesive, and, after donning the garment, coupling the first and second fastener members one to the other for securing the garment to the body. The garment being removable by decoupling the first and second fastener members and removing the garment from the body. The first fastener member being resusable while the pad is adhered to the user.

6 Claims, 6 Drawing Sheets

REUSABLE STRAPLESS AND BACKLESS BRA

CROSS REFERENCE TO RELATED APPLICATION

This application is related to pending provisional Patent Application No. 60/346,706, filed Jan. 7, 2002 entitled "SNAP FASTENER, ESPECIALLY FOR A REUSABLE STRAPLESS BACKLESS BRA, GARMENTS OR OTHER ITEMS". Applicant claims priority of the above-identified patent application which is incorporated herein by reference.

FIELD OF THE INVENTION

This invention relates to fasteners for securing items such as garments to the body of a user, and more particularly to a reusable fastener having a pad adherable to a user's body for attaching garments directly to a user's body.

BACKGROUND OF THE INVENTION

A wide variety of garment fasteners exist for use in clothing and undergarments. Most currently used garment fasteners involve the use of a shoulder strap and/or back strap to secure clothing to a user's body. However, occasions arise that such a strap-type fastener is esthetically unpleasant when used, or is restrictive to the user. Regardless of the size, shape, or color, strap-type garment fasteners still have visible straps which are often undesirable, especially when worn with strapless gowns or similar garments.

Strapless and backless bras and self-supporting breast cups are known in the art. Normally, a strapless and backless bra or self-supporting breast cups are used when wearing a revealing garment such as a wedding gown, evening gown, swim suit or tank top. However, none of the presently known strapless and backless bras provide a one piece bra that can be worn again, without reapplying new two-sided adhesive tape to both the bra and the body of the user. For example, U.S. Pat. No. 6,257,952 to Valentin discloses a strapless and backless bra which adheres to a person's body using two sided tape. The tape is not reusable and must be removed and replaced before the bra can be worn again once the bra is removed from the user's body.

Similarly, U.S. Pat. No. 5,755,611 to Noble discloses self-supporting breast cups that adhere to the body using double sided tape. The Noble patent discloses a tape that is renewable or reusable by reapplying a liquid adhesive to the tape strips and allowing it to dry prior to reusing the tape.

Based on the foregoing, it is the general object of the present invention to provide a fastener for attaching a garment or other item to the body of a user that improves over, or overcomes the problems and drawbacks of the prior art.

SUMMARY OF THE INVENTION

The present invention provides a reuseable fastener for attaching a garment or other item to a user including a pad having an adhesive on one side and a first fastener member attached to an opposing side thereof, the adhesive being adherable to a user's body for attaching the pad thereto. A second fastener member attachable to a garment portion or other item is also provided, the second fastener member being releasably coupleable to the first fastener member such that a garment or other item can be attached to a user's body. For example, a garment having such a second fastener member attached thereto can be worn by a user by adhering the pad to the user's body via the adhesive, and, after donning the garment, coupling the first and second fastener members one to the other for securing the garment to the body. The garment being removable by decoupling the first and second fastener members and removing the garment from the body. Accordingly, the garment can be removed or reworn a plurality of times as long as the pad remains adhered to the body.

The present invention is applicable to reusable, strapless and backless bras, or other garments including swim suits or the like that can be secured directly to a person's skin or body. Additionally, the present invention fastener could be used to attach a watch, earrings, jewelry or other items or accessories to a user's body. For clarity, the invention is described herein as a fastener for use with a reusable, strapless and backless bra, however, it should be recognized that the present invention is equally applicable to many other garments or items.

The present invention fastener on a reusable, strapless and backless bra overcomes the deficiencies of the prior art by providing support for the breasts while being easily reusable and comfortable to wear. The present invention when applied to a reusable, strapless and backless bra includes a bra having two cups each having inner and outer sides thereof. The inner sides of the cups are connected together by a bridge connector. The bra includes a wing portion positioned proximate to the outer side of each cup and a female snap fastener positioned distally on each wing portion. Also provided is a pair of adhesive pads having a complementary male snap fastener attached to a soft cloth backing, and a hypoallergenic, pressure sensitive dermal adhesive on a body side of the pads.

The above and other objects, features and advantages of the present invention will become more apparent by reference to the following detailed description of the invention and drawings, which follows.

Figure 1:
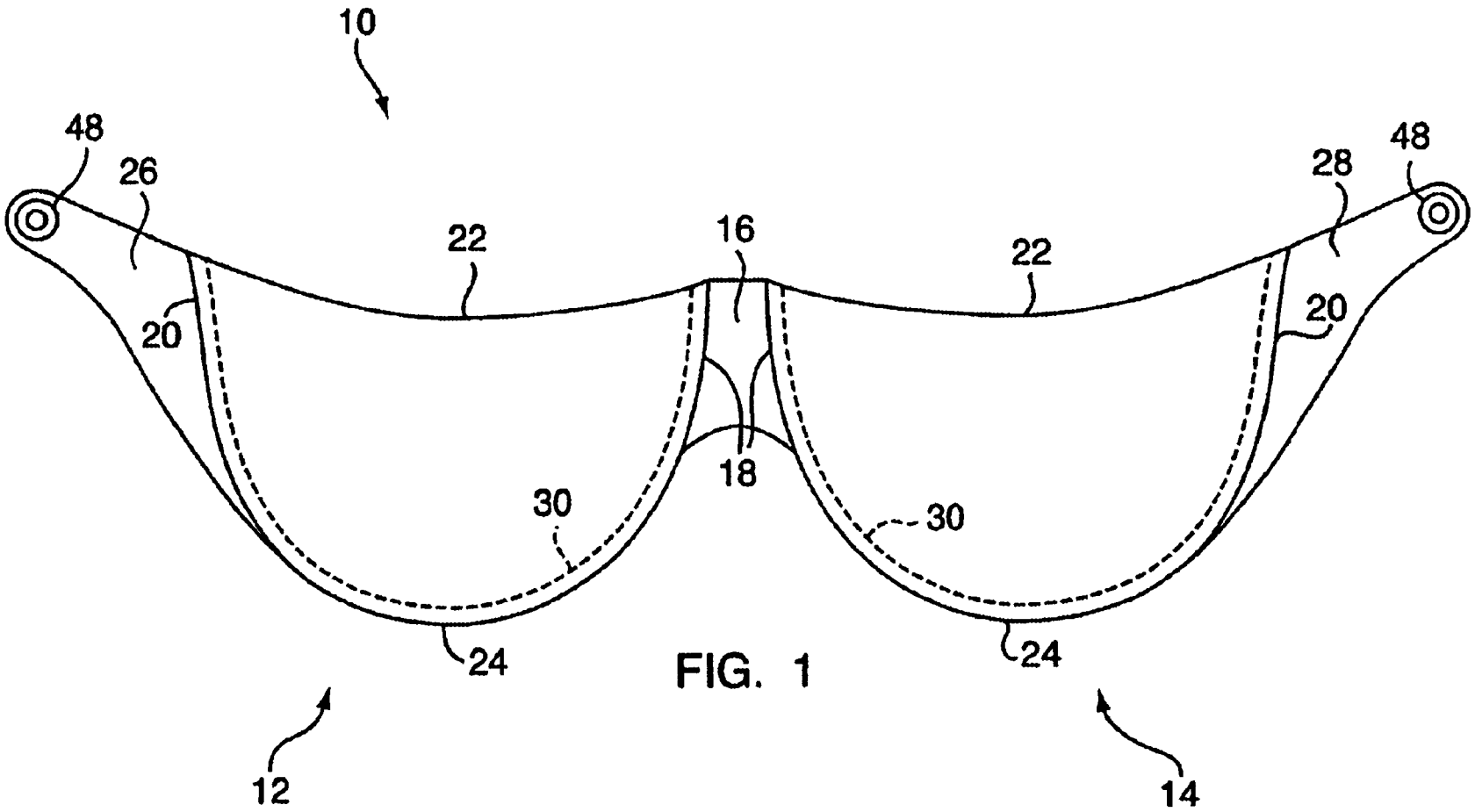
FIG. 1 is a front elevational view of a reusable, strapless and backless bra with a female snap fastener on each wing in accordance with a first embodiment of the present invention.

It should be noted that the drawings of the invention are not to scale and are merely schematic representations, not intended to portray specific parameters of the invention. The drawings are intended to depict only typical embodiments of the invention, and therefore should not be considered as limiting the scope of the invention. In the drawings, like numbering represents like elements between the drawings.

DETAILED DESCRIPTION OF THE INVENTION

Figure 2:
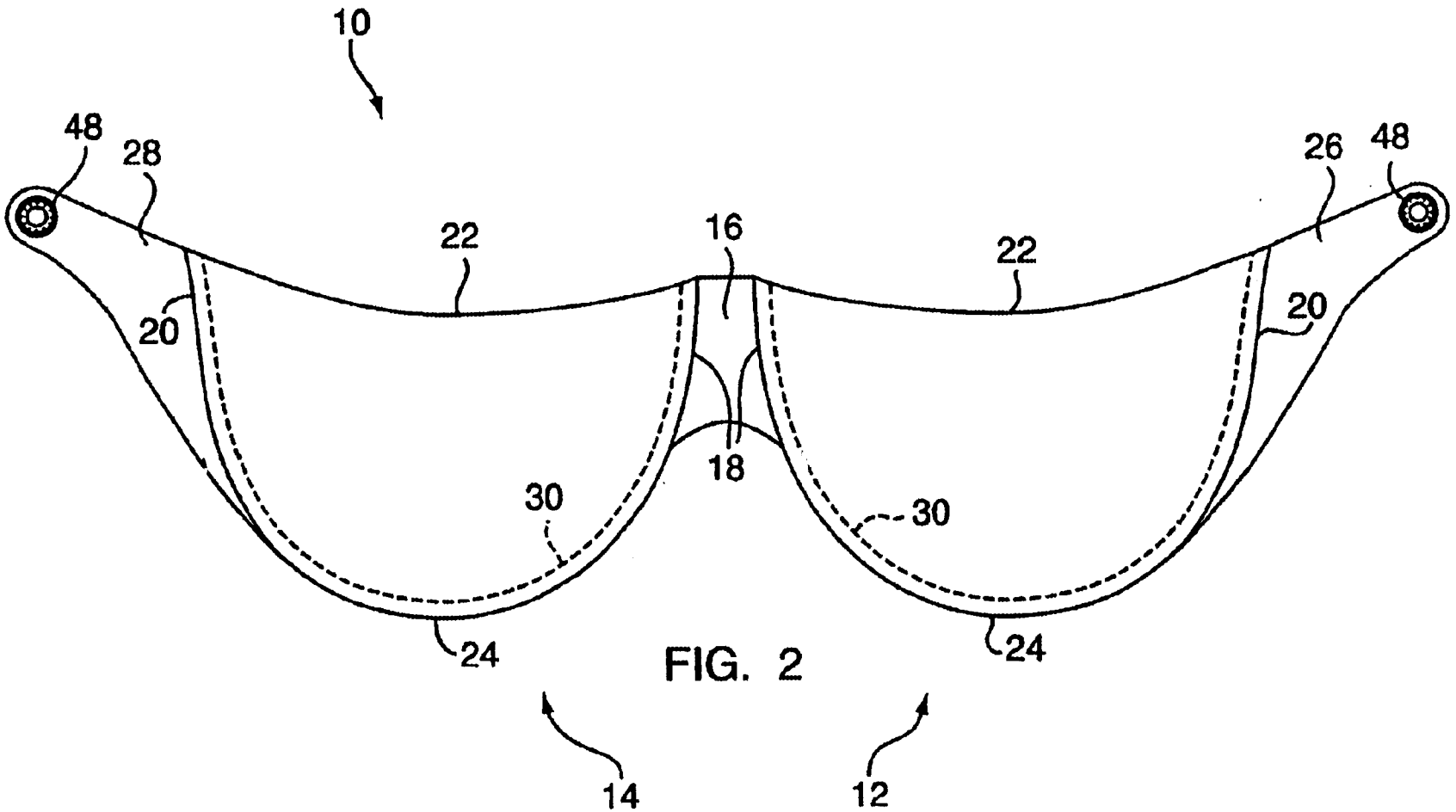
FIG. 2 is a back elevational view of a reusable, strapless and backless bra with a female snap fastener on each wing in accordance with a first embodiment of the present invention.

FIGS. 1 and 2 represent a first embodiment of a reusable, strapless and backless bra having a fastener according to the present invention. Bra 10 includes cups 12 and 14, which are connected by bridge connector 16. Cups 12 and 14 each comprise a cup shaped region which are manufactured in different sizes for different breasts sizes. Cups 12 and 14 each have an inner side 18, an outer side 20, a top end 22 and a closed bottom end 24. Cups 12 and 14 may also be manufactured in a shape that conforms to the lower portion of a user's breast so that the upper portion of the breast is not contained within the cup.

Cups 12, 14 and the bridge connector 16 of bra 10 comprise polyester laminated to polyurethane foam, and the wings 26 and 28 comprise nylon and spandex such that these portions of the bra are strecthable. However, it should be appreciated that many equivalents exist which could also be used.

Each cup 12 and 14 of the bra 10 comprises a rigid material as underwire 30 that is positioned along the periphery of the cups 12 and 14, including the inner side 18, outer side 20 and the closed bottom end 24. The underwire 30 aids in the lifting and supporting of the user's breasts. The rigid material that could be used as the underwire 30 are lightweight aluminum or plastic. However, it should be appreciated that many other equivalents exist that could be used as the underwire 30.

The bridge connector 16 represents any form of connection between the cups 12 and 14, such as a unitary piece of material. However, it should be appreciated that many equivalents exist that could be used. For example, bridge connector 16 could be an eye and hook connector, a releasable snap fit connector, or a system for joining the inner sides 18 of cups 12 and 14 together.

Wings 26 and 28 are positioned proximate the outer sides 20 of the cups 12 and 14, respectively. Wings 26 and 28 are generally triangular in shape which taper at the outer ends thereof. A female snap fastener 48 is disposed near the tapered end of each of the wings 26 and 28.

Figure 3:
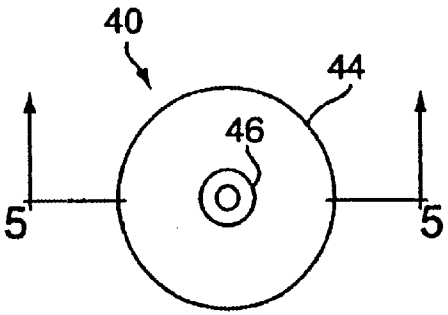
FIG. 3 is a front elevational view of an adhesive pad having a male snap fastener in accordance with the present invention.
Figure 4:
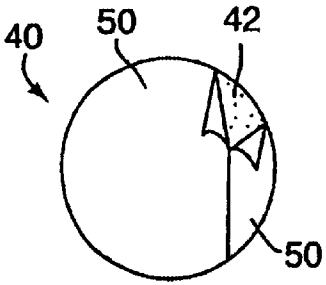
FIG. 4 is a back elevational view of the adhesive pad of FIG. 3 with a release liner partially peeled back to expose the adhesive.
Figure 5:
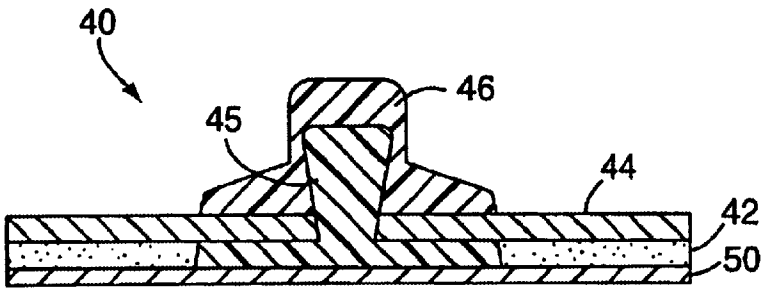
FIG. 5 is partial cross sectional view showing the adhesive pad of FIG. 3 taken at the line 5—5.

Attachment of the bra 10 to the user 36 is accomplished using an adhesive pad 40. As depicted in FIGS. 3 to 5, an adhesive pad 40 includes an adhesive 42 disposed on one side of the pad 44 for adhering the pad to a user's body. A release liner 50 is provided to protect the adhesive 42 prior to using the pad 40. The pad 40 includes a soft cloth backing 44 having a male snap fastener 46 centrally attached thereto. FIG. 5 shows the male snap fastener 46 in a cross-sectional view wherein a core portion 45 of the male snap fastener 46 is shown.

3M Corporation of St. Paul, Minn. manufactures a Red Dot™ product line having a variety of hypoallergenic, pressure sensitive adhesive manufactured with the male snap fastener 46 attached. The Red Dot™ products are available in different sizes, shapes and backings, such as foam, soft cloth and clear plastic. Additionally, various adhesives are available providing pads 40 that will adhere to the skin or body of a user for various lengths of time. Accordingly, a garment having the pad 40 and fastener members according to the present invention for securing the garment to the body can be put on or taken off many times over various extended time periods, depending on the type of adhesive 42 used on the pad.

A male snap fastener can also be friction fitted or riveted to other hypoallergenic, pressure sensitive, dermal adhesive pads such as the Blenderm™ products also available from 3M Corporation. Accordingly, it should be appreciated that many other similar products exist that could be used in place of the adhesive pad 40.

To wear the bra 10, a user 36 would first snap the female snap fasteners 48 found on wings 26 and 28 onto the complementary male snap fasteners 46 attached to the adhesive pads 40. User 36 would then peel the release liner 50 from the adhesive pads 40 to expose the adhesive side 42. Next, user 36 would adhere the adhesive side of the pad 42 on one side of the chest 32 by applying a gentle, even pressure to the adhesive pad 40. User 36 would then pull or stretch bra 10 across the breasts 52 and 54 and again apply gentle, even pressure to the adhesive pad 40 on the other side of the chest 34. This example is for illustration only and not intended to be limiting. For example, user 36 can apply the body adhesive side 42 to the side of the chest 34 first and then to chest 32. Alternatively, the pads 40 could be adhered to the chest first and the bra 10 secured to the pad s 40 thereafter via the snap fasteners 46 and 48 respectively.

Figure 6:
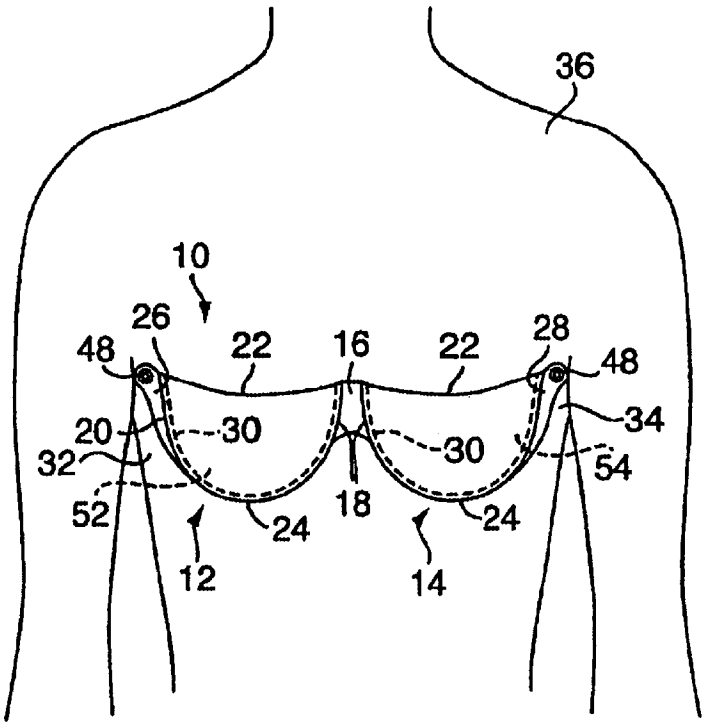
FIG. 6 is a front elevational view of a reusable, strapless and backless bra in accordance with the present invention shown as worn on a user.

FIG. 6 shows the front view of bra 10 as worn on user 36. As shown in FIG. 6, the wings 26 and 28 are adhered only to the outer side of the chest 32 and 34 near the mid-axillary line of the user 36 to provide maximum support.

Other types of fasteners could be used in place of the snap fastener shown and described with respect to the bra 10 and are within the scope of the present invention. For example, the fastener could include Velcro™, wherein the adhesive pads 40 and wings 26 and 28 would each include complementary Velcro™ strips for releasably coupling the pads 40 to wings 26 and 28. Additionally, other types of hook and loop fasteners could be used to couple a garment to the adhesive pad 40. The fastener could also be a button and loop type, where, for example, adhesive pads 40 has a button attached to the cloth backing 44, while a single loop piece is positioned on each of the wings 26 and 28. Also, other fasteners or systems for joining the adhesive pads 40 to each of the wings 26, 28 could be utilized and are within the scope of the invention.

Figure 7:
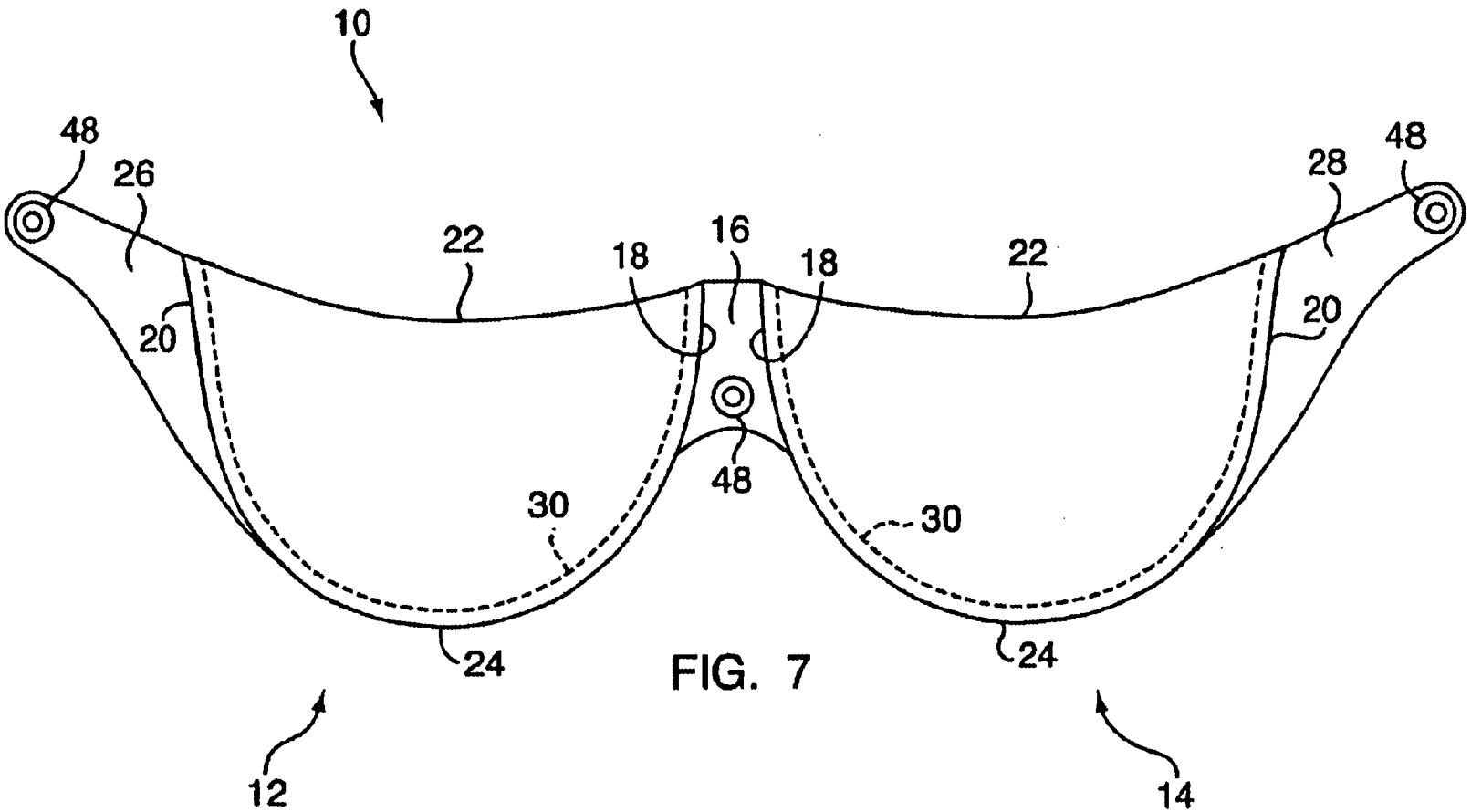
FIG. 7 is the front elevational view of a reusable, strapless and backless bra with a female snap fastener on each wing and bridge connector in accordance with a second embodiment of the present invention.
Figure 8:
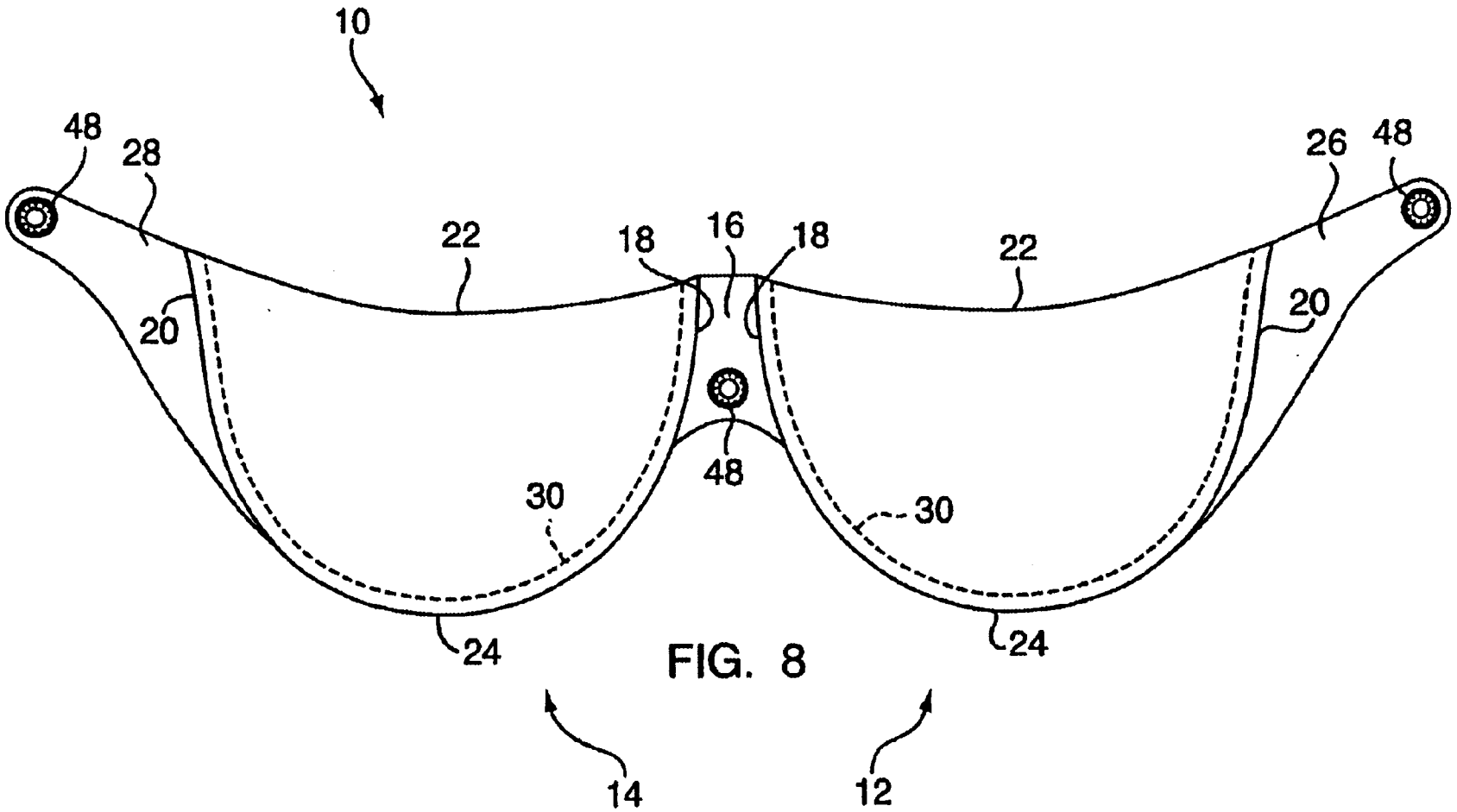
FIG. 8 is a back elevational view of the bra of FIG. 7.

FIGS. 7 and 8 show a second embodiment of a reusable, strapless and backless bra 100 in accordance with the present invention. Similar to bra 10 disclosed above, bra 100 also includes cups 12 and 14, which are connected at the inner sides 18 thereof by bridge connector 16.

Figure 9:
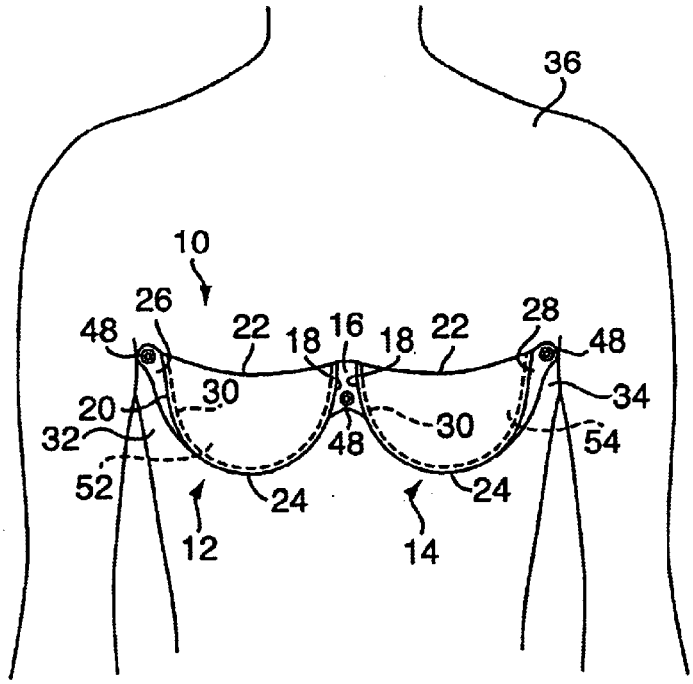
FIG. 9 is a front view of the bra of FIG. 7 shown as worn on a user.

As depicted in FIGS. 7 and 8, bra 100 has an additional complementary female snap fastener 46 attached to the bridge connector 16. Accordingly, the bra 100 is especially useful for large breasted women whose breasts need further support in additional to that provided by the wings 26 and 28. Similar to the bra 10, the bra 100 is removably secured to the chest 36 using adhesive pads 40 as depicted in FIG. 9.

To wear the bra 100, the user 36 would first snap the female snap fasteners 48 found on wings 26, 28 and bridge connector 16 onto the complementary male snap fasteners 46 attached to the adhesive pads 40. User 36 would then peel the release liner 50 off the adhesive pads 40 to expose the adhesive 42. Next, user 36 would adhere the pads 40 on one side of the chest 32 by applying a gentle, even pressure to the adhesive pad 40. User 36 would then pull or stretch bra 100 across the breasts 52 and 54 and again apply gentle, even pressure to the adhesive pad 40 on the other side of the chest 34. Lastly, user 36 will apply gentle, even pressure to the adhesive pad 40 on the bridge connector 16. This example is for illustration only and not intended to be limiting. For example, user 36 can apply the body adhesive side 42 to the side of the chest 34 first and then to chest 32.

Figure 10A:
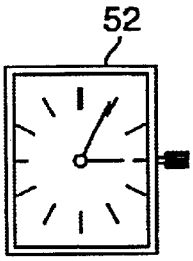
FIGS. 10A and 10B are respectively, front and rear views of a watch having a fastener member according to the present invention for attaching the watch to a user.
Figure 10B:
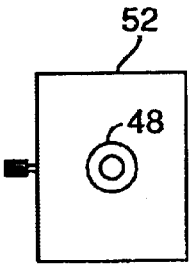
Figure 11A:
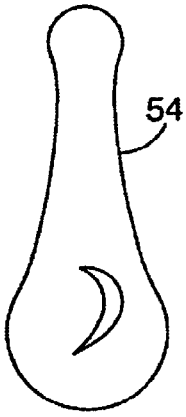
FIGS. 11A and 11B are respectively, front and rear views of an earring having a fastener member according to the present invention for attaching the earring to a user.
Figure 11B:
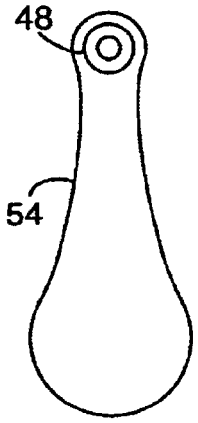

FIGS. 10A and 10B show a watch 52 having a female snap fastener 48 attached to a rear side thereof. The watch 52 is removably attachable to a user's body using an adhesive pad 40 shown in FIGS. 3–5. Similarly, FIGS. 11A and 11B depict an earring 54 having a female snap fastener 48 attached to a rear side thereof. The earring 54 is removably attachable to a user's body using an adhesive pad 40 shown in FIGS. 3–5. Accordingly, the reusable fastener of the present invention including the adhesive pad 40 and cooperating recloseable fastener members such as snap fasteners 46 and 48 attached one to the adhesive pad 40 and the other to an article of clothing, jewelry or other items is a convenient and novel apparatus for attaching objects directly to a user's body both for functional applications such as clothing or a wrist watch as well as decorative accessories such as earrings or jewelry.

Figure 12A:
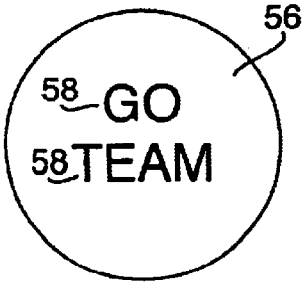
FIGS. 12A and 12B are respectively, front and rear views of a sign having a fastener member according to the present invention for attaching the sign to a user's body.
Figure 12B:
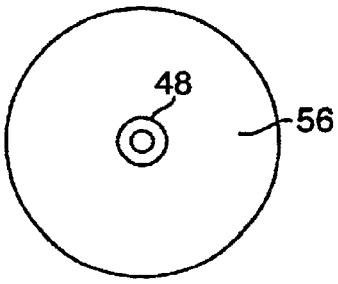

Addtionally, the reuseable fastener of the present invention can be used to removably attach signs or advertising indicia to one's body as shown in FIGS. 12A and 12B. An adhesive pad 40 having a first fastener member attached thereto is adhered to the body as described above and a sign 56 or other type of advertising media including advertising indicia 58 having a second fastener member attached thereto such that the first and second fastener members are coupleable, one to the other for removably securing the sign or advertising indicia to one's body.

The foregoing description of the embodiments of the invention has been presented for purposes of illustration and description. It is not intended to be exhaustive or to limit the invention to the precise forms disclosed, and obviously, many modifications and variations are possible. Such modifications and variations that may be apparent to a person skilled in the art are intended to be included within the scope of this invention as defined by the claims apended hereto.

What is claimed is:

1. A strapless and backless bra having a reusable fastener for securing the bra to the body of a user, the bra comprising:

first an second cup portions for supporting the breasts of a user, each of the cup portions having an inner and outer side;

a bridge connector attaching the inner sides of the first and second cup portions together;

a pair of stretchable wing portions, each wing portion extending from an inner end at the outer side of one of the first and second cup portions to an outer securing end;

a pair of first fastener members, each first fastener member attached to one of the wing portions at the outer securing end;

a pair of pads each pad having adhesive on one side for adhering the pads to the user's body at a position adjacent the outer securing end of one wing portion when the bra is worn and a second fastener member on a side opposite the adhesive, the second fastener members being releasably coupleable to one of the first fastener members at the outer securing end of the wing portion;

whereby when the bra is worn the stretchable wing portions provide flexibility between the outer side of each of the first and second cup portions and the first fastener members at the securing ends without stressing the releasably coupled first and second fastener members or the adhesive during stretching and extending movements of the body.

2. The bra as defined in claim 1 wherein the adhesive is waterproof.

3. The bra as defined in claim 1 wherein the first and second fastener members are cooperating female and male snap connectors respectively.

4. The bra as defined in claim 1 wherein the first and second fastener members include a cooperating button and loop assembly.

5. The bra as defined in claim 1 wherein the bridge connector includes a detachable coupler.

6. The bra as defined in claim 1 wherein an additional first fastener member is provided secured to the bridge connector for coupling to an additional second fastener member attached to a third adhesive pad, the third adhesive pad for adhering to the center of a user's chest such that the bra provides additional support for the use's breasts.

* * * * *

UNITED STATES PATENT AND TRADEMARK OFFICE

CERTIFICATE OF CORRECTION

PATENT NO. : 6,814,648 B2
DATED : November 9, 2004
INVENTOR(S) : Laurence Wai Yiu Chong It is certified that error appears in the above-identified patent and that said Letters Patent is hereby corrected as shown below:

Title page,
Item [75], Inventors, please delete "Lawrence" and insert -- Laurence --.
Item [57], ABSTRACT, please delete "resuable" and insert -- reusable --.

Column 6,
Line 47, please delete "use's" and insert -- user's --.

Signed and Sealed this

First Day of February, 2005

JON W. DUDAS
*Director of the United States Patent and Trademark Office*